United States Patent [19]

Jacobsen

[11] Patent Number: 4,821,505

[45] Date of Patent: Apr. 18, 1989

[54] METHOD AND APPARATUS FOR SPINNING YARN

[76] Inventor: Alan N. Jacobsen, 14 Raheen Drive, Kew, Victoria, Australia

[21] Appl. No.: 23,866

[22] PCT Filed: Jun. 6, 1986

[86] PCT No.: PCT/AU86/00165

§ 371 Date: Jan. 20, 1987

§ 102(e) Date: Jan. 20, 1987

[87] PCT Pub. No.: WO86/07392

PCT Pub. Date: Dec. 18, 1986

[30] Foreign Application Priority Data

Jun. 7, 1985 [AU] Australia ..... PH0954

[51] Int. Cl.[4] ..... D01H 7/898; D01H 1/135

[52] U.S. Cl. ..... 57/401; 57/408; 57/411; 57/413

[58] Field of Search ..... 57/400, 401, 411, 408, 57/413, 415

[56] References Cited

U.S. PATENT DOCUMENTS

| | | | |
|---|---|---|---|
| 3,328,949 | 7/1967 | Pavek et al. | 57/413 X |
| 3,538,698 | 11/1970 | Ripka et al. | 57/413 |
| 3,557,543 | 1/1971 | Krause | 57/411 |
| 3,620,002 | 11/1971 | Grishin | 57/413 |
| 3,703,074 | 11/1972 | Staneff | 57/408 |
| 3,834,148 | 9/1974 | Sakurai et al. | 57/413 |
| 4,005,568 | 2/1977 | Folk | 57/415 X |
| 4,077,196 | 3/1978 | Kotter et al. | 57/415 |
| 4,091,605 | 5/1978 | Jacobsen | 57/401 |
| 4,179,874 | 12/1979 | Jacobsen | 57/401 |
| 4,281,507 | 8/1981 | Didek et al. | 57/411 X |
| 4,458,477 | 7/1984 | Raasch et al. | 57/411 X |
| 4,459,800 | 7/1984 | Stahlecker | 57/411 |
| 4,567,723 | 2/1986 | Safar | 57/411 X |

*Primary Examiner*—John Petrakes

*Attorney, Agent, or Firm*—Samuels, Gauthier, Stevens & Kehoe

[57] ABSTRACT

A method and apparatus of forming a fibre assembly to be spun to form a yarn. The separated fibres are entrained in an air stream (61) and delivered in a tangential direction into a converging annular passage (64). The fibres are straightened in their travel through the passage (64) and issue as a peripheral curtain into a fibre collection zone (67), where the fibres merge to form a coaxial fiber assembly with the passage (64), and are shed from the airstream which is diverted to be withdrawn rearwardly from the fibre collection zone (67). The cohered fibre assembly is withdrawn forwardly from the collection zone to be spun to form a yarn.

18 Claims, 4 Drawing Sheets

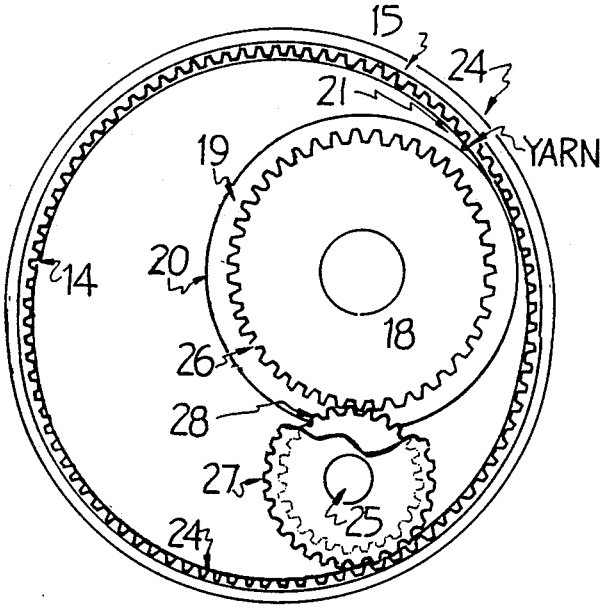
FIGURE. 3
FIGURE. 4
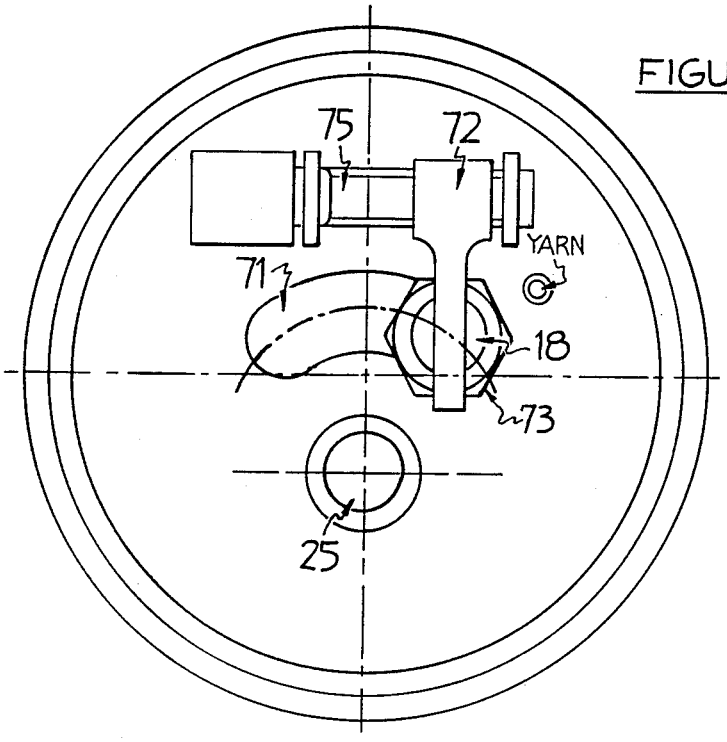

METHOD AND APPARATUS FOR SPINNING YARN

This invention relates to a method and apparatus for spinning yarn made from natural, artificial, or synthetic fibres.

In the practice of open-end rotor spinning, a collector groove in the rotor is employed for the collection and condensing of the fibres carried to it by means of an airstream. The deposited assembly of fibres is withdrawn from the collector groove to the central point of the rotor adjacent the axis thereof, the assembly of fibres thus being in the form of a crank. The crank action achieved as the rotor rotates is instrumental in inserting one twist in the forming yarn for each revolution of the rotor. In this rotor system, there is naturally a weakness in the assembly of fibres constituting the crank, as there is a lack of twist in that portion of the assembly of fibres unless specific measures are taken.

The rotor spinning system also has certain limitations mainly to do with the high rotor speeds required for economic production, and the difficulties in providing economically the high levels of twist as required for the production of fine counts of yarn.

The development of friction spinning, whereby the yarn is formed by drawing the assembly of fibres over a rotating friction surface, and caused to roll thereon, overcomes the limitations of the rotor spinning technique in respect to its restriction to one twist of the forming yarn for each revolution of the rotor. Thus the rate of twist insertion is greatly enhanced with the added advantage of comparatively low mechanical speeds.

Australian Pat. No. 501999 relates to one form of friction spinning wherein a yarn is spun by delivering a flow of fibres in an airstream to form an open-ended, cohering fibre assembly, which is drawn through a gap between two surfaces of revolution provided by two rings situated one within the other, so that the fibre assembly during its passage from one end of the friction surfaces to the other, is acted on by the frictional content with each surface, and twist inserted, while the yarn product is gripped and drawn off by the withdrawal rollers.

The effective operation of spinning machines in accordance with the beforementioned patent is largely dependent upon the positive rolling action in twisting and backtwisting the fibre assembly, which is characteristic of the system so long as an 'open-end' exists upstream of the friction surfaces. The convex surface of the inner friction ring fitting within the concave surface of the outer friction ring presents a more extensive and more efficient friction contact with the intervening fibre formation than is obtainable with the employment of two convex surfaces in juxtaposition as proposed in other friction spinning systems. Also the gradual taper of the concave and convex surfaces fitting one within the other, when the inner ring has a lesser diameter than the outer ring and is not coaxial with it, enables the position of the intervening fibre formation to be precisely adjusted according to the thickness of the fibre formation. Thus the inner ring may be rotatably relocated to present a wider or narrower gap as appropriate for the particular width of the fibre formation. A firm and satisfactory 'nip' is thus formed for the passage of the forming yarn therethrough, with advantageous frictional effect in comparison to the alternative method of employing two juxtaposed convex surfaces of revolution.

The method of delivery and the assembling of the delivered longitudinally orientated fibres into a condensed and cohering form for presentation to the appropriate gap between the friction surfaces, and the maintaining of an open-end condition with free rotation of the fibre assembly, are essential to achieving a satisfactory friction spun yarn of required strength and evenness.

For high speed friction spinning maximum twisting efficiency is necessary without an excess of slippage of the rolling fibre assembly between the friction sufaces apart from that involved in the longitudinal withdrawal. The effect of the friction rolling should be so far as possible to roll the fibre assembly uniformly from its tail to the fixed point downstream from the friction surfaces at which true twist is retained. A corresponding degree of true twist is lost when the rolling of the fibre assembly upstream of the friction surfaces is impeded. The degree of true twist achieved is commensurate with the open-ended rotation of the upstream fibre assembly. Any seizure of the tail or fibre assembly may cause a breakdown of the spin, or slippage may be caused between the fibre assembly and the friction surfaces resulting in loss of twist, or uneven yarn may be produced with periodic weak spots.

By pre-forming the fibre assembly before passing it through the gap in frictional contact with the surfaces of revolution it is possible to achieve a high percentage of the theoretical twist calculated from the diameter of the yarn and the diameter and rotary speed of the friction surfaces in comparison to other friction spinning systems, because the friction contact is firmer and more positive and because the upstream rotation of the fibre assembly back to the open-end is not restrained by frictional contact.

In view of the extremely high twisting capacity of the open-end friction spinning system, a minor degree of slippage may be practically acceptable so long as it is uniform in the system as between spinning heads, but it is clear that such slippage should be minimal in the interest of energy consumption and economic production, and for the further good reason of producing good quality yarn, and uniform as between all spinning heads of an industrial machine.

The desirable characteristics of yarn strength and evenness depend upon the proper structuring of the fibres in the fibre assembly. The fibres should be longitudinally orientated rather than spirally joined, but there should be a good interlacing of the individual fibres from the core of the fibre assembly to the fibres making up the external layers of the fibre assembly.

It is also to be noted that evenness of a spun yarn in an open-end system depends to a considerable extent upon the evenness of the silver, and on the evenness of the fibre flow from the beater, followed by the joining of the fibres without superfluous buckling, and without loss of fibres going to waste, into an orderly fibre assembly. The requirement is the same for friction spinning as for rotor spinning, but the assembling of the fibres in friction spinning is necessarily much quicker because of the higher throughput rate of friction spinning.

It is the object of this invention to provide a more effective method and apparatus for the collection and spinning of fibres into yarn with a high production rate and employing relatively low rotational speeds of the spinning heads.

There is thus provided by the present invention a method of preparing fibres for spinning to form a yarn comprising, maintaining an airstream in a converging passage of annular cross-section travelling towards the smaller end thereof, said passage being concentric to a longitudinal axis and having a coaxial assembly zone at the smaller end, entraining fibres in said airstream to form a substantially uniform seriate fibre distribution within said annular passage to pass therealong to the assembly zone and so accelerate and straighten the individual fibres, withdrawing air from said assembly zone in the axial direction opposite to the direction of convergence, and withdrawing an assembly of fibres from the assembly zone in the axial direction of convergence, the seriately distributed fibres entering the assembly zone as a converging curtain to initially adhere at there leading end with the fibre assembly and be drawn to a generally longitudinal disposition to axially build on the fibre assembly as the latter is withdrawn from the assembly zone in a continuous form.

The fibres fed into the airstream within the converging passage are entrained therein as a series of individual fibres evenly distributed around the converging passage, and also seriately occupying the cross-section of the passage. The individual fibres are conveyed towards the assembly zone axis where the fibres intersect with one another and cohere at their leading ends together with the existing fibre assembly which in operation is continuously withdrawn in the axial direction of the friction twisting mechanism.

As the passage is a converging one the airstream in the passage consequently accelerates and thereby generally straightens the fibres and orientates them longitudinally.

The fibres have greater mass and inertia than the air, and as the fibres from all around the end of the converging passage approach the tail forming area of the fibres assembly the fibres are at peak speed but the transporting air is being caused to change direction rearwardly under influence of a rearward suction duct. The leading ends of the fibres are trapped in the tail of the fibre assembly and the reversing air is caused to shed its fibres. This reversing airstream retards and straightens the trailing ends of the cohering fibres without dislodging them form the tail. As the dimensions and shape of the converging passage channelling the airflow is sufficient to accommodate many series of discrete fibres with the effect of random layers separated by air all following separate flight paths towards their apices along the longtidinal axis in the fibre assembly zone.

The outer wall of the converging passage is significantly longer than the inner wall and the throat is defined between the ends of the inner and outer walls. In operation therefore the innermost fibres arriving from all around the converging passage merge first as they intersect at their apices in the axial vicinity of the end of the inner wall. This group of intersecting fibres represents the tip of the tail of the fibre assembly, and finally forms the core of the completed fibre assembly.

The complete fibre assembly builds up from a cone-shaped tail. As the intersecting fibres from the innermost series merge at their leading ends and cohere as attachment to the previously formed and withdrawing fibre assembly, further oncoming fibres from the innermost series replace the withdrawing ones, which are in turn overlayed by fibres from a second and successive series of fibres all following their separate courses to their apices as determined by the depth of their flight position in the converging passage, and the tail building process continues until withdrawal of the fibre assembly retires the former part of the tail from range of the oncoming fibres and that part of the fibre assembly is complete.

The fibres closest to the longer out wall of the converging passage are the last to join the tail of the fibre assembly and such fibres form the periphery of the fibre assembly, and the final yarn. A moiety of the air transporting these fibres is drawn forwardly through an orifice from the fibre assembly zone into a plenum under the influence of the suction source. Thus the tail of the fibre assembly is made progressively from the innermost fibres to the outermost fibres, and it remains cone shaped in operation and its formation is contained within the apex of the innermost fibres and the apex of the outmost fibres.

It is important to note that the rearward exhaustion of air advantageously straightens the fibres cohering in the tail, and that the merged leading ends are rapidly wound into the rotating tail of the fibre assembly in its open-end operation. Mutual coherence of the fibres and the rotation of the fibre assembly induced upstream from and by the twist input ensure that loss of fibres in the escaping airflow is avoided. The speed and force of the converging fibres is mitigated by the angle of approach of the fibres as governed by the angle of the converging passage, the retardation of the fibres imposed by the escaping airflow, the rapid rotation of the fibre assembly and tail in its open-end state, and to some extent by the relatively high withdrawal rate of the fibre assembly made feasible by the efficient friction twisting system. These factors minimise the number of misaligned and buckled fibres.

No rearward growth of the fibre assembly tail back into the converning passage is possible so long as withdrawal of the fibre assembly continues at a rate relative to the count of the yarn and the inflow of the fibres in conformity with the principle of conservation, and the calculated degree of drafting.

The fibre assembly zone, the plenum, and the gap between the friction surfaces are conveniently coaxial.

The withdrawal of the completed fibre assembly is directly along the axis of the plenum through an aperture into the twisting apparatus. Ambient air is drawn through the twisting apparatus through the aperture into the plenum under the influence of the suction source. This flow of air is opposite in direction to the widthdrawing fibre assembly and assists in maintaining the fibre assembly taut and centralised. There is also a smoothing effect on the fibre assembly.

The form of the aperture is in the semblance of a widening round channel extending into the plenum so as to act simultaneously as a restraining guide to avoid lateral deflection of the fibre assembly under centrifugal forces, and as a channel for the radially dispersing airstream which merges with the moiety of radially dispersing air from the fibre assembly zone and orifice en route through the plenum to the suction source.

It is important that the axial distance form the fibre assembly zone to the gap between the friction surfaces is short so that it is relatively stiff and not subject to 'whipping' under centrifugal effect but maintained in a steady central position.

The rearward suction duct which is connected through the inner truncated cone and through the housing to the suction source, is also used effectively when seeding up for the commencement of the spinning operation.

Apparatus for assembling fibres for spinning to form a yarn comprising a converging passage means of annular cross-section having a concentric fibre assembly zone at the smaller end of the passage, means to deliver fibres entrained in air into said passage to travel therealong to said assembly zone, the annular passage and the assembly zone being adapted so that the fibre issue into the assembly zone in the form of converging curtain to form a coaxial fibre assembly, and means to withdraw the fibre assembly from said zone in a continuous form.

Conveniently there is provided a diverging passage means with the large end thereof merging with the large end of the converging passage, and said means to deliver the fibres is arranged to deliver the fibres into the diverging passage at a location spaced from the location of the merging of the diverging and converging passages.

The means to impart twist to the assembly of fibres may comprise a member having a first surface of revolution of fixed diameter mounted for rotation about the axis of first said surface, said axis being parallel to and offset from the axis of the assembly of fibres issuing from the already mentioned orifice and aperture, leading, into and out of the plenum, so that in operation the assembly of fibres is drawn across said first surface of revolution in frictional contact therewith whereby the assembly of fibres is rolled on its axis as the first surface rotates to form a twisted yarn.

Conveniently there is provided a further member having a second surface of revolution of fixed diameter, said further member being mounted for rotation about an axis parallel to the axis of the first surface off revolution, and means to rotate said member and further member in opposite direction, with said first and second surfaces being located so that in use said assembly of fibres is drawn between said surfaces in frictional contact with each to effect the rolling of the assembly of fibres on its axis.

The assembly of fibres is drawn through a gap between the two surfaces of revolution which is cuneiform in shape because of the different diameters of these surfaces, and the fact that their axes are excentric.

The radical width of the gap may therefore be varied by adjustment of the relation of the two surfaces. Thus different thicknesses of forming yarns may be rolled securely within the appropriate width of gap between the friction surfaces.

Directly on the downstream end of the surfaces of revolution a fixed position guide may be placed to secure the longitudinal path of the forming yarn through the gap between the surfaces and to the withdrawal rollers.

The foregoing general procedure is described for a single head prototype machine. In a production machine intended for industrial spinning numerous linked heads side by side are installed with a common suction source and common but detachable drives for the various driven assemblies incorporated in each spinning head.

The system has no necessary requirement of moving parts in the area of the machine handling the air and fibre flow in the zones between the fibre beater and the twisting mechanism.

Also the amount of process air is reduced to a minimum in that it is used only to transport the light, open fibres within smooth static channels, and to provide and maintain a balanced central position of the freely rotating open-end fibre assembly. The airstream is not required to pass through diminutive perforations which are prone to blockage from broken fibres or other foreign material. Neither is the airstream required to provide aerodynamic assistance to the rolling of the forming yarn between the friction surfaces. Otherwise a far greater volume and pressure of process air would be required.

The subject system has the advantage of the much more free rotation of the tail in its open-end situation in conjunction with the positive rolling of the forming yarn between the friction surfaces and a better transmission of backtwist to the tail. This enables a superior realisation of twist according to the theoretical relation of the diameter of the forming yarn to the peripheral speed of the friction surfaces in comparison to other systems.

The subject system lends itself readily to the use of numerous existing electronic and automatically operating devices which are currently a part of the known art of spinning. These devices and techniques represent refinements and automation which may be adapted for use in this system and further enhance the inherent economy and efficiency of an advanced industrial model in its practical application. These controls and aids to productivity and economy of operation are not in themselves essential to the operation of the basic machine, and for the sake of simplicity they have been omitted from the present description. However it is to be understood that devices providing information and control for automated processes may be incorporated readily in multi-head production machinery embodying the novel features of the system disclosed in the present invention.

The invention will be more readily understood from the following description of one practical arrangement of apparatus for carrying the invention into practice as illustrated in the accompanying drawings.

In the drawings:

FIG. 3 is a sectional view along the line 3—3 in FIG. 2 of the rotating members between which the assembly of fibres is drawn.

FIG. 4 is an end view showing the rotating members gap adjustment.

Figure 1:
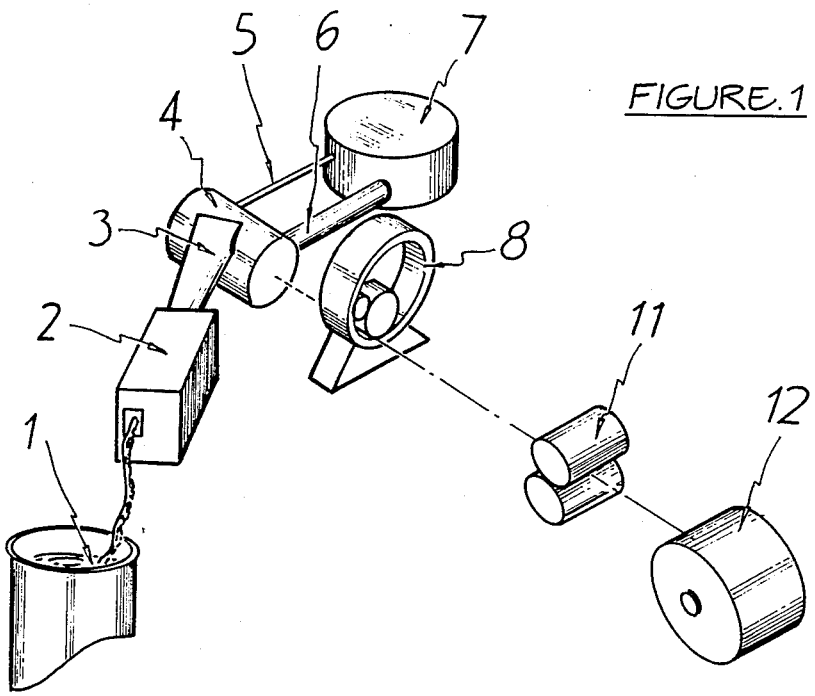
FIG. 1 is a diagrammatic representation of the method of spinning fibres into yarn.

Referring now to FIG. 1 a sliver of cotton or other fibres 1 is fed into a suitable beater 2 where the fibres are individually separated from the sliver and launched into an airstream. Several satisfactory types of beaters are known. The rate of feed is controllable in the known manner according to the specific requirement of fibres, to match the required count of yarn being produced, and the calculated offtake rate of the spun yarn.

The fibres from the beater are carried in an airstream through the duct 3 and delivered to the fibre condensing unit 4. The fibre condensing unit is a major part of the present invention and will be described in greater detail hereinafter. Air is withdrawn from the condenser unit via the ducts 5 and 6 by the suction source 7. The assembly of fibres issuing from the condensing unit 4 are passed to the friction twister unit 8 which will also be described in greater detail hereinafter. The twisted fibre yarn is withdrawn from the twister unit 8 by the withdrawal rollers 11 and thereafter passed to the yarn reception spool 12.

Figure 2:
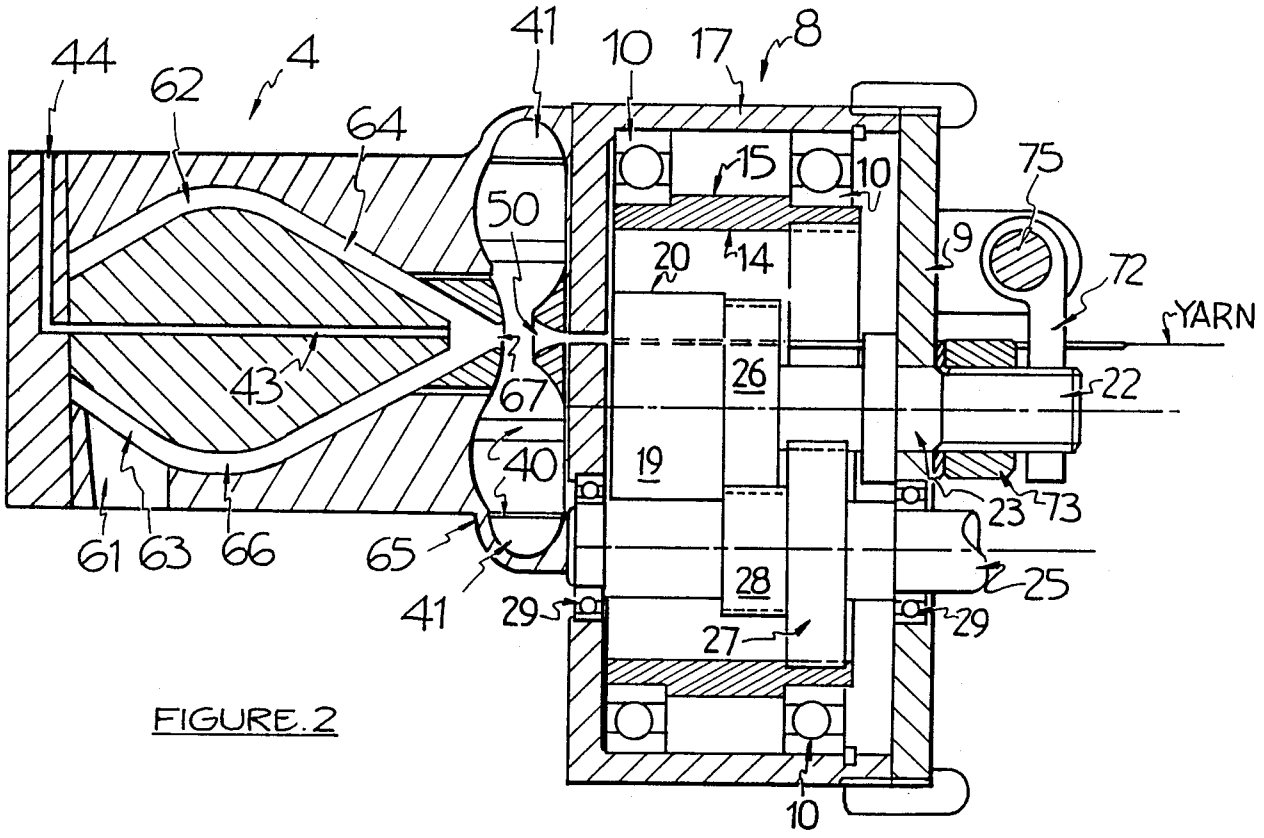
FIG. 2 is a vertical section view of one embodiment of the yarn spinning machine.

Referring now to the FIGS. 2 and 3 the fibre twisting unit 8 has a ring 15 with an internal surface 14 forming one of two surfaces of revolutions. The ring 15 is supported by the bearing 10 for rotation in the housing 17 about the axis of the internal surface 14. The twisting unit also has the roller 19 with an external surface 20 forming the other of the two surfaces of revolution. The roller 19 is supported for revolution on a bearing (not shown) carried on the shaft 22 supported at 23 in end wall 9 of the housing 17. The axis of the roller 19 is eccentric to the ring so that in one area 24 (FIG. 3) the internal surface 14 and external surface 20 are spaced radially to provide the gap 21 through which the assembly of fibres is drawn and rolled between the surfaces 14 and 20.

The drive shaft 25 is supported in bearings 29 in the housing 17, and coupled to a suitable driving motor not shown.

The ring 15 is formed with an internal gear tooth formation 30 and the roller 19 with an external gear tooth formation 26, that mesh respectively with gears 27 and 28 on the drive shaft 25. The gear ratios are selected so that the internal surface 14 of the ring 15 and the external surface 20 of the roller 19 have the same peripheral speed. As the ring 15 and an internal tooth formation and the roller 19 an external tooth formation, they will rotate in opposite directions.

A coating of friction material is provided on the surfaces 14 and 20 to reduce slippage of the assembly of fibres as it is rolled between the surfaces 14 and 20 in the area 24.

As viewed in FIG. 3, when in operation, the drive shaft 25 is rotated in the clockwise direction and thus drives the ring 15 in the clockwise direction and the roller 19 in the anti-clockwise direction. Thus the fibre assembly passing between the surfaces 14 and 20 will be rotated in clockwise direction, and so the yarn produced will have a Z twist.

The twist described twisting unit 8 is particularly suitable for use with the fibre collecting and concentrate method and apparatus of the present invention as will be hereinafter described, however, it is to be understood that the twisting unit may be used to apply twist to assemblies of fibres which are formed from any appropriate fibre collecting and concentrating apparatus.

The condensing unit 4 has a longitudinal axis parallel with the axes of the ring 15 and roller 19 and aligned with the centre line of the gap at 16 at the location 24 between the peripheral surfaces 14 and 20.

The location 24 through which the assembly of fibres pass between the surfaces 14 and 20 remains fixed during operation and accordingly the condensing unit 4 also remains stationary. Provision may be made for limited relative movement between the twister unit and the condensing unit 4 so the assembly of fibres may enter between the surfaces 14 and 20 of the twister unit, where the gap therebetween is appropriate to the diameter of the yarn to be produced. However, other constructions of the twisting unit 8 may be arranged so the location at which the assembly of fibres pass between the surfaces of revolution may move to accommodate different yarn counts, and to facilitate the procedure of presenting a seed yarn on start-up for the attachment of the fibres to the tale of the seed-yarn in the fibre assembly zone.

The air and entrained fibres enter the condensing unit 4 through the opening 61 from the beater 2 and duct 3 to pass into the annular passage 62. The annular passage 62 has a diverging portion 63 extending forward from the opening 61 and merges smoothly at 66 with the converging portion 64 of the annular passage 62. The smaller diameter end of the converging portion of passage 64 communicates with the interior of the fibre assembly zone 67 and hence with the suction chamber 65.

The air and fibres entrained therein enter the divergent portion 63 of the annular passage 62, in a generally tangential direction, and the progressively increasing area of the passage will result in a spreading or separation of the individual fibres from one another to reduce the extent of entanglement or intermingling of the fibre. This spreading of the fibres in the portion 63 will assist in promoting the staightening and aligning of the fibres with the direction of air flow as the fibres pass into and along the converging portion 64 of the passage. The progressive increase in the velocity of the air as it travels along the converging portion 64 has a straightening effect on the fibres as they tend to be pulled forward by their leading end, where the air velocity is greater than at the trailing end.

As a result of the convergence of the passage portion 64 the fibres converge from around the full circumference of the passage at the longitudinal axis of the annular passage 62 in the assembly zone 67. The fibres build up in contiguous order as they join at their various apices spaced along the axis of the assembly zone.

The innermost series of fibres form the core of the fibre assembly, and the outermost series form the peripheral surface of the fibre assembly.

The trail of the assembly of fibres rotates as a result of the twist created by the rotating surfaces 14 and 20. The incoming fibres attach themselves to the rotating tail in the assembly zone and are progressively withdrawn therefrom.

Air issues from the converging passage into the chamber 65 which is in communication with the suction source 7 via the ports 40 and header 41. This suction source 7 cause the air to separate from the fibre assembly and diverge generally radially outward. The outward air flow exists around the periphery of the assembly of fibre and so assists in maintaining the central position of the assembly of fibres. The fibres are thus shedded from the air stream and cohere with one another to form the assembly of fibres that passes to the twisting unit 6.

The aperture 50 in the wall of the housing 17 is coaxial with converging passage 64 and the internal surface of the aperture 50 is of a substantially smooth converging shape so as to assist in the leading in of the assembly of fibres to the aperture 50. The pressure conditions in the suction chamber 65 maintains the air flow through the aperture 50 into the chamber which assist in centralising and stabilising the assembly of fibres.

Figure 5:
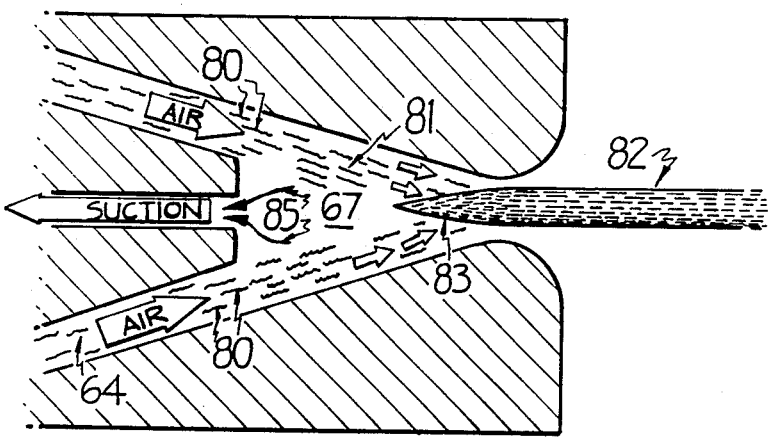
FIG. 5 is an enlarged illustrative view of the converging passage and fibre assembly zone showing air flows and fibre flow.
Figure 6:
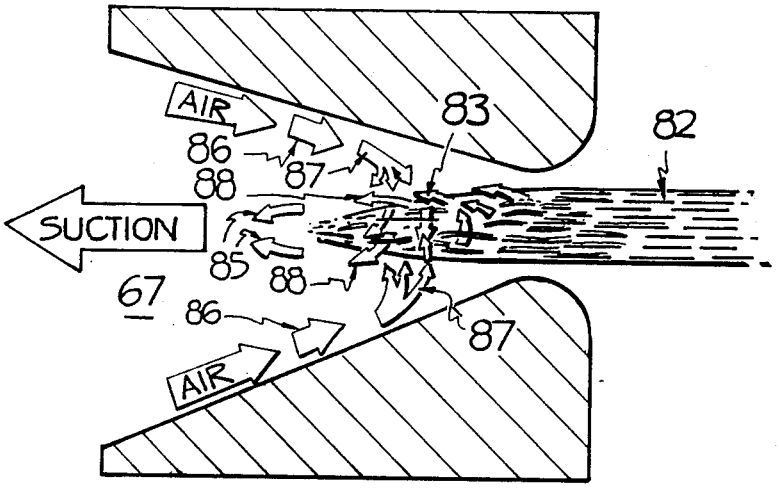
FIG. 6 is a further enlarged view similar to FIG. 5.

The suction duct 43 extends rearwardly from the assembly zone 67, coaxial therewith and the end 44 thereof is coupled to the suction source to draw a small volume of air rearward from the assembly zone. As can be seen in FIGS. 5 and 6, which are respective enlargements of the fibre assembly zone 67, the fibres 80 move from the annular converging passage 64 into the fibre assembly zone in the form of a generally conical curtain 81. This conical formation of fibres constitutes the open-end that permit the fibre assembly 82 to freely rotate on its axis without inducing twist into the assembly.

The leading ends of the individual fibres, as they meet with the tail 83 of the fibre assembly, cohere therewith to build into the tail. At the same time the effects of the suction in the duct 43 cause the air flow or a substantial part thereof, entering the assembly zone from the converging passage 64, to reverse in direction and travel axially rearward into the duct 43. This reverse air flow is depicted by the arrows 85 in FIG. 6. The air flow from the passage 64 (arrows 86) sweeps in an arc as indicated by arrows 87 and 88 into the tail of the fibre assembly.

As the fibres are of a greater mass they substantially continue their previous path to join the fibre assembly and are so shed from the reversing air flow. The reversing air flow also assists in longitudinally aligning the fibre newly attached to the fibre assembly tail, and holding the tail straight and taut in the axial direction.

The reverse air flow is also useful for guiding and holding a seed yarn in position on starting spinning operations. A valve not shown may be used to cut off suction from the duct chamber 65 when feeding in the seed yarn.

As previously referred to the position at which the assembly of fibres pass between the surfaces 11 and 16 in the twisting unit 8 may be controlled to suit different diameter yarns, since the width of the gap between the surface varies as a result of their eccentricity. As seen in FIGS. 3 and 4, the shaft 22 extends through the arcuate slot 71 in the housing 17, this slot being coaxial with the drive shaft 25. Variation on the position of the shaft 22 along the slot 71 will vary the gap 24 between the surfaces 14 and 20 where the assembly of fibres pass therebetween. The shaft may be locked in the desired position by the nut 73 engaged on the threaded end of the shaft. The adjustment may be effected by the lug 72 that engage a slot in the end of the shaft 22. The lug is threadably engaged by the screw 75 rotatably supported on the housing 17.

As an alternative to the gear train previously described to drive the ring 15 and roller 19 from the shaft 25, a friction based drive may be used. In this form the friction surfaces 14 and 20 each engage the peripheral surface of the shaft 25, so drive is transmitted directly to the ring 15 and roller 19 from the shaft 25. Sufficient contact pressure in establishment so that there is effectively no slip between the friction surfaces 14 and 20 and the shaft 25 so each friction surface is travelling at the same peripheral speed.

In another variation it is proposed to assert in regularizing the fibre flow in the annular passages and reduce irregularities that may arise from the operation of a single beater to provide the fibre to the annular passages. In this variation a doubling effect may be obtained by employing a plurality of beaters with individual ducts that each feed into the annular passage at respective locations around the circumference of the passage. If desired the ducts from each beater main be formed to form a single circumferential mouth extending around the annular passage.

I claim:

1. A method of preparing fibres for spinning to form a yarn comprising, maintaining an airstream in a converging passage of annular cross-section travelling towards the smaller end thereof, said passage being concentric to a longitudinal axis and having a coaxial assembly zone at the smaller end, entraining fibres in said airstream to form a substantially uniform seriate fibre distribution within said annular passage to pass therealong to the assembly zone and so accelerate and straighten the individual fibres, withdrawing air from said assembly zone in the axial direction opposite to the direction of convergence, and withdrawing an assembly of fibres from the assembly zone in the axial direction of convergence, the seriately distributed fibres entering the assembly zone as a converging curtain to initially adhere at there leading end with the fibre assembly and be drawn to a generally longitudinal disposition to axially build on the fibre assembly as the latter is withdrawn from the assembly zone in a continuous form.

2. A method of preparing fibres for spinning to form a yarn comprising, maintaining an airstream in a converging passage of annular cross-section travelling towards the smaller end thereof, said passage being concentric to a longitudinal axis and having a coaxial assembly zone at the smaller end, entraining fibres in said airstream to form a subsatantially uniform seriate fibre distribution within said annular passage to pass therealong to the assembly zone and so accelerate and straighten the individual fibres, delivering the fibres from said passage into the assembly zone around the full periphery thereof to form a coaxial fibre assembly in said zone, and withdrawing said fibre assembly axially from said assembly zone in a continuous form.

3. A method as claimed in claim 1 or 2 wherein the airstream initially travels a diverging annular passage that merges with and is coaxial to the converging passage, and the fibres are fed into the diverging passage to be dispersed about the periphery thereof and to promote separation of the fibres from one another as passing there along to the converging passage.

4. A method of preparing fibres as claimed in claim 3 wherein air is also withdrawn from the assembly zone in the direction of withdrawal of the fibre assembly, and that air is diverted outward from the fibre assembly upon exiting the assembly zone.

5. A method as claimed in claim 2 wherein air is withdrawn from the assembly zone in the axial direction opposite to the direction of convergence of the passage to shed fibres from the air to cohere to and extend the fibre assembly tail.

6. A method as claimed in claim 2 including the additional steps of imparting twist to the assembly of fibres after withdrawal from the assembly zone and as it continues to move in the axial direction.

7. A method as claimed in claim 6 wherein the assembly of fibres is drawn across and in frictional contact with a surface of revolution revolving on its axis disposed parallel to the direction of movement of the assembly of fibres to cause the assembly of fibres to roll on said surface about the axis of the assembly of fibres to form a twisted yarn.

8. Apparatus for assembling fibres for spinning to form a yarn comprising a converging passage means of annular cross-section having a concentric fibre assembly zone at the smaller end of the passage, means to deliver fibres entrained in air into said passage to travel therealong to said assembly zone, the annular passage and the assembly zone being adapted so that the fibres issue into the assembly zone in the form of a converging curtain to form a coaxial fibre assembly, and means to withdraw the fibre assembly from said zone in a continuous form.

9. Apparatus as claimed in claim 8 wherein means are provided to withdraw air from the assembly zone in an axial direction opposite to the direction of convergence of the passage to provide an air flow in the region of the fibre assembly opposite to the direction of withdrawal of the fibre assembly.

10. Apparatus as claimed in claim 8 or 9 wherein the assembly zone extends in the axial direction between the respective small ends of the inner and outer walls of the converging passage.

11. Apparatus as claimed in claim 8 including a diverging passage means with the larger end thereof merging with the larger end of the converging passage means, and said means to deliver the fibres is arranged to deliver the fibres into the diverging passage means at a location spaced from the location of merging of the converging and diverging passages.

12. Apparatus as claimed in claim 11 wherein the means to deliver the fibres is arranged to deliver the fibres into the diverging passage in a generally tangential direction in respect of the diverging passage.

13. Apparatus as claimed in claim 8 wherein the means to deliver the fibres is arranged to deliver the fibres in a generally tangential direction in respect of the convergin passage.

14. Apparatus as claimed in claim 8 wherein the converging passage is defined by respective internal and external substantially conical surfaces.

15. Apparatus as claimed in claim 8 wherein the assembly zone communicates with a chamber, and means are provided to withdraw from said chamber air entering same from the assembly zone chamber and/or the air withdrawal means being arranged so the air flows outward from the assembly of fibres about the periphery thereof.

16. Apparatus as claimed in claim 8 including means to impart twist to the assembly of fibres comprise a member having a first surface of revolution of fixed diameter mounted for rotation about the axis of said first surface, said axis being parallel to and offset from the direction of the assembly of fibres issuing from the mouth so that in use the assembly of fibres are drawn across said first surface of rotation in frictional contact therewith whereby the assembly of fibres is rolled on its axis as the first surface rotates to form a twisted yarn.

17. Apparatus as claimed in claim 16 wherein there is provided a further member having a second surface of rotation of fixed diameter, said further member being mounted for rotation about an axis parallel to the axis of the first surface of rotation, and means to rotate said member and further member in opposite direction with said first and second surface have the same peripheral speed, said first and second surfaces being located so in use said assembly of fibres is drawn between said surfaces in frictional contact with each to effect the rolling of the assembly of fibres on its axis.

18. Apparatus as claimed in claim 17 wherein the relative spacing of the first and second surfaces in the radial direction is adjustable to permit production of yarns of different counts.

* * * * *